US011220651B2

(12) United States Patent
Kitagawa et al.

(10) Patent No.: US 11,220,651 B2
(45) Date of Patent: Jan. 11, 2022

(54) RECIPROCATING-TYPE COMPRESSOR OIL

(71) Applicant: SHELL OIL COMPANY, Houston, TX (US)

(72) Inventors: Mai Kitagawa, Minato-ku (JP); Hiroshi Kaneko, Minato-ku (JP); Mitsuhiro Nagakari, Minato-ku (JP)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 17/053,914

(22) PCT Filed: May 16, 2019

(86) PCT No.: PCT/EP2019/062705

§ 371 (c)(1),
(2) Date: Nov. 9, 2020

(87) PCT Pub. No.: WO2019/219858

PCT Pub. Date: Nov. 21, 2019

(65) Prior Publication Data

US 2021/0238494 A1 Aug. 5, 2021

(30) Foreign Application Priority Data

May 18, 2018 (JP) ..... JP2018-096080

(51) Int. Cl.

| | |
|---|---|
| ***C10M 169/04*** | (2006.01) |
| ***C10M 129/10*** | (2006.01) |
| ***C10M 129/54*** | (2006.01) |
| ***C10M 137/02*** | (2006.01) |
| ***C10M 141/10*** | (2006.01) |
| *C10N 30/02* | (2006.01) |
| *C10N 40/30* | (2006.01) |

(52) U.S. Cl.

CPC ..... *C10M 169/04* (2013.01); *C10M 129/10* (2013.01); *C10M 129/54* (2013.01); *C10M 137/02* (2013.01); *C10M 141/10* (2013.01); *C10M 2203/003* (2013.01); *C10M 2207/026* (2013.01); *C10M 2207/144* (2013.01); *C10M 2223/049* (2013.01); *C10N 2030/02* (2013.01); *C10N 2040/30* (2013.01)

(58) Field of Classification Search

CPC ..... C10M 2207/262; C10M 2207/289; C10M 2223/041; C10M 2223/049; C10M 2203/1006; C10M 2203/1025; C10M 2207/026; C10M 169/04; C10M 129/10; C10M 137/02; C10M 141/10; C10M 129/54; C10M 2207/144; C10M 2203/003; C10M 2203/1065; C10N 2040/30; C10N 2030/04; C10N 2030/08; C10N 2030/02; C10N 2030/10

See application file for complete search history.

(56) References Cited

U.S. PATENT DOCUMENTS

| | | | | |
|---|---|---|---|---|
| 4,652,385 | A | 3/1987 | Cohen | |
| 5,912,212 | A * | 6/1999 | Igarashi | C10M 141/06 508/275 |
| 6,172,014 | B1 | 1/2001 | Meyers | |
| 2006/0040833 | A1 | 2/2006 | Al-Akhdar et al. | |
| 2008/0110799 | A1 * | 5/2008 | Matsui | C10M 169/04 208/19 |
| 2008/0135260 | A1 | 6/2008 | Berzin et al. | |
| 2009/0181871 | A1 * | 7/2009 | Shah | C10M 107/02 508/459 |

FOREIGN PATENT DOCUMENTS

| | | | |
|---|---|---|---|
| JP | H11189781 | A | 7/1999 |
| JP | 2018028024 | A | 2/2018 |
| WO | 2007150022 | A2 | 12/2007 |
| WO | 2007150040 | A1 | 12/2007 |
| WO | 2009024553 | A1 | 2/2009 |
| WO | 2010069986 | A1 | 6/2010 |
| WO | 2018060117 | A1 | 4/2018 |

OTHER PUBLICATIONS

International Search Report and Written Opinion received for PCT Patent Application No. PCT/EP2019/062705, dated Aug. 13, 2019, 9 pages.

* cited by examiner

*Primary Examiner* — Vishal V Vasisth
(74) *Attorney, Agent, or Firm* — Shell Oil Company

(57) ABSTRACT

The invention provides a compressor oil, wherein 2,6-di-tert-butylphenol and tris (2,4-di-tert-butylphenyl) phosphite are added to a base oil having a naphthene content of from 17 to 30% based on the total amount of the base oil, and has a pour point of −25° C. or lower. 2,6-di-tert-butylphenol is effective when it is contained in an amount of from 0.5 mass % to 6.0 mass % based on the total amount of the compressor oil, and tris (2,4-di-tert-butylphenyl) phosphite is effective when it is contained in an amount of from 0.3 mass % to 2.0 mass % based on the total amount of the compressor oil. Furthermore, adding an alkaline earth metal salt of alkylsalicylic acid in combination is even more effective. The amount thereof used is preferably from 0.05 mass % to 2.0 mass %.

13 Claims, No Drawings

RECIPROCATING-TYPE COMPRESSOR OIL

CROSS REFERENCE TO RELATED APPLICATIONS

This is a national stage application of International Application No. PCT/EP2019/062705, filed 16 May 2019, which claims benefit of priority to Japanese Patent Application No. 2018-096080, filed 18 May 2018.

FIELD OF THE INVENTION

The present invention relates to a lubricating oil composition and particularly relates to a reciprocating compressor oil.

BACKGROUND OF THE INVENTION

A compressor is a machine that compresses air such as gas and increases its pressure. This compressor is broadly classified into three types: a reciprocating type (reciprocating type), a rotating type, and a turbo type. However, lubrication points differ depending on the type, and accordingly the required performance of compressor oil differs.

In the reciprocating compressor, the reciprocating piston compresses the gas in the cylinder, so the compressor oil used for the reciprocating piston directly contacts the high temperature/high pressure of the compressed gas and tends to be easily carbonized. If the carbon thus generated adheres to the periphery of the valve, there is a risk of malfunctioning of the valve or risk of ignition or explosion due to heat accumulation of adhered carbon.

Therefore, the reciprocating compressor oil required to have an extremely important performance that no carbon is produced. Also, in order to be able to withstand the above high temperature and high pressure, it is necessary for reciprocating compressor oil to have high thermal stability/oxidation stability and to reduce generation of sludge. In addition, when used in cold regions or outdoors, it is necessary to be stable even at low temperatures, so pour point is also required to be low.

Conventionally, phosphorus-based antioxidants, amine-based antioxidants, phenol-based antioxidants, and the like have been used as additives in order to meet the demand in such compressor oil, as in JPH11-189781.

The present invention intends to provide a reciprocating compressor oil which can withstand high temperature and high pressure, generate little sludge and can be stably used over a long period of time by obtaining sufficient oxidation stability by selection of base oil and addition of additives.

SUMMARY OF THE INVENTION

The inventors conducted various studies on additives having effective antioxidant performance in compressor oil and carried out research. As a result, they found that using 2, 6-di-tert-butylphenol and tris (2, 4-di-tert-butylphenyl) phosphite in combination has very good results. Thus, the present invention has been completed based on these findings.

In other words, the present invention relates to the reciprocating compressor oil, wherein 2, 6-di-tert-butylphenol and tris (2, 4-di-tert-butylphenyl) phosphite are added in combination to the base oil.

As additive, 2, 6-di-tert-butylphenol is effective when it is contained in an amount of between 0.5 mass % and 6.0 mass % based on the total amount of the compressor oil, and tris (2, 4-di-tert-butylphenyl) phosphite is effective when it is contained in an amount of between 0.3 mass % and 2.0 mass % based on the total amount of the compressor oil.

In addition, using an alkaline earth metal salt of alkylsalicylic acid in combination as an additive is even more effective. The amount thereof used is preferably between 0.05 mass % and 2.0 mass % based on the total amount.

The base oil of the compressor oil uses mineral oil and/or synthetic oil, but it is preferable that the base oil contains a relatively large amount of naphthene. The naphthene content in the total amount of the base oil is about 17 to 30%, preferably 18 to 28%, more preferably 20 to 25% in the % $C_N$ of ring analysis according to ASTM D3238.

DETAILED DESCRIPTION OF THE INVENTION

According to the present invention, even when the oil is used under conditions of high temperature and high pressure, its antioxidant performance is excellent, the production of sludge is small, the formation of sediments in oil is small, and it can be stably used over a long period of time.

The base oil of the reciprocating compressor oil of the present invention uses mineral oil or synthetic oil. In the base oil classification of API, base oils of Group 1, Group 2, Group 3, Group 4 and the like are used, but these base oils can be appropriately mixed and used.

As this base oil, the oil containing a relatively large amount of naphthene is preferable, and the naphthene content in the total amount of the base oil is preferably from about 17% to 30% in % $C_N$ of the ring analysis according to ASTM D3238. Further, it is preferably from 18 to 28%, more preferably from 20 to 25%.

As described in the patent literature, the naphthene-containing base oil has high solubility in additives and sludge as compared with the base oil containing a large amount of paraffin, so it is especially useful when used for the reciprocating compressor oil since the deposit (carbon deposit) is soft even when it is carbonized.

When the proportion of naphthene component is small, carbonization tends to occur, and the generated carbon becomes hard and deposits and sticks, which tends to cause malfunction of the compressor and the like. On the other hand, when the naphthene component is excessive, since the naphthene component is highly volatile, the base oil evaporates during use and increases the kinematic viscosity of the lubricating oil, which is not preferable. Thus, the content of the naphthene component in the total amount of the base oil has an appropriate range, and it is preferable to set the above ratio.

As described above, 2, 6-di-tert-butylphenol is added to the base oil and used. This 2, 6-di-tert-butylphenol is a phenolic substance having the structure shown below.

Chemical formula 1:

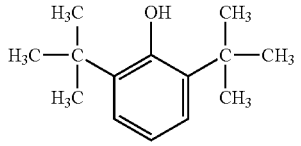

This 2, 6-di-tert-butylphenol is widely known as an antioxidant and has a structure similar to the widely used BHT (butylhydroxytoluene) (2, 6-di-tert-butyl-4-methylphenol) described below. It lacks the methyl group at the 4-position of the benzene ring of BHT.

Chemical formula 2:

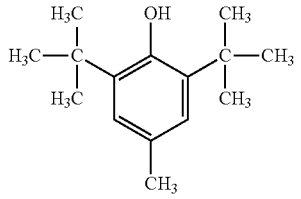

Also, it has a structure similar to the following 4,4'-methylenebis (2,6-di-tert-butylphenol) which is widely used and also widely known as antioxidant.

Chemical formula 3:

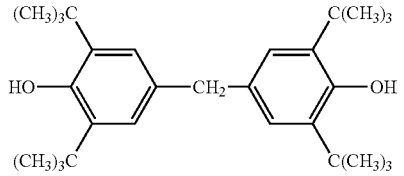

As mentioned above, 2, 6-di-tert-butylphenol is known as phenolic substance having a structure similar to BHT and 4, 4'-methylenebis (2, 6-di-tert-butylphenol) [2, 2', 6, 6'-tetra-tert-butyl-4,4'-methylenediphenol]. However, there is concern of sublimability, but the inventors found excellent oxidation preventing performance in the present invention.

Further, the 4, 4'-methylene bis (2, 6-di-tert-butylphenol) is hardly decomposable and highly concentrated, so it is sometimes designated under a Monitoring Chemical Substance as its long-term toxicity against humans or higher predatory animals is not clear. Hence, it is effective to avoid use from such aspect as well.

The 2, 6-di-tert-butylphenol exists in a state of forming a dimer due to the fact that the 4-position of the benzene ring is a hydrogen atom as described above, and is difficult to sublimate. In addition, due to the combination effect (synergistic effect) of the additives, the expression of the dimer antioxidant function could be found.

Such a 2, 6-di-tert-butylphenol is used in an amount of between 0.5 mass % and 6.0 mass %, preferably between 1.0 mass % and 5.0 mass %, based on the total amount of the compressor oil.

This 2, 6-di-tert-butylphenol is used in combination with tris (2, 4-di-tert-butylphenyl) phosphite which is a phosphate ester-based antioxidant as an additive.

Chemical formula 4:

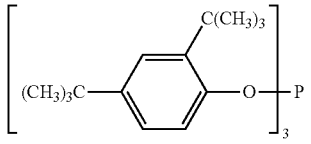

When used in combination with phosphate ester-based antioxidant, it is possible to obtain a compressor oil having a stable high-temperature and high-pressure resistance over a long period of time with further improved the antioxidant performance and reduction in generation of sludge.

The tris (2, 4-di-tert-butylphenyl) phosphite is also used in an amount of between 0.3 mass % and 2.0 mass %, preferably in the range of from 0.5 mass % to 1.0 mass %, based on the total amount.

Using this alkaline earth metal salt of alkylsalicylic acid in combination with this compressor oil as an additive is even more effective. Alkaline earth metals thereof include calcium, magnesium and the like, but in general, Ca salicylate is often used.

The amount thereof used is preferably between 0.05 mass % and 2.0 mass %, preferably from 0.075 mass % to 1.5 mass %, and more preferably from 0.075 mass % to 1.0 mass %, based on the total amount.

The compressor oil may contain known additives if necessary, for example, extreme pressure agents, rust preventive agents, demulsifiers, copper deactivators, antiwear agents, dispersants, friction modifiers, corrosion inhibitors, pour point depressants, antifoaming agents and various other additives. These additives may be blended singly or in combination of several kinds. In this case, an additive package not containing an antioxidant or a detergent dispersant may be used.

The pour point (pour point measured by the method described in JIS K 2269) of the reciprocating compressor oil according to the present invention is preferably −30° C. or lower, more preferably −35° C. or lower. A low pour point indicates that the lubricating oil composition is excellent in low temperature characteristics.

EXAMPLES

Preliminary Experiment

Firstly, a preliminary experiment was conducted to select the antioxidant. In the preliminary experiment, the following materials were prepared.

Base oil 1: Fischer-Tropsch base oil by gas-to-liquid method (Properties and the like: Kinematic viscosity at 40° C.; 17.1 $mm^2/s$, Kinematic viscosity at 100° C.; 4.0 $mm^2/s$, Viscosity index; 135, density at 15° C.; 0.814 $g/cm^3$, % $C_A$ of ring analysis according to ASTM D 3238 method; 0%, % $C_N$ of ring analysis according to ASTM D 3238 method; 8%, and % $C_P$ of ring analysis according to ASTM D 3238 method; 92%)

Base oil 2: Purified mineral oil belonging to Group I (Properties and the like: Kinematic viscosity at 40° C.; 25.1 $mm^2/s$, Kinematic viscosity at 100° C.; 4.7 $mm^2/s$, Viscosity index; 107, Density at 15° C.; 0.863 $g/cm^3$, % $C_A$ of ring analysis according to ASTM D 3238 method; 3%, % $C_N$ of ring analysis according to ASTM D 3238 method; 28%, and % $C_P$ of ring analysis according to ASTM D 3238 method; 69%)

Base oil 3: Purified mineral oil belonging to Group I (Properties and the like: Kinematic viscosity at 40° C.; 53.2 $mm^2/s$, Kinematic viscosity at 100° C.; 7.6 $mm^2/s$, Viscosity index; 106, Density at 15° C.; 0.875 $g/cm^3$, % $C_A$ of ring analysis according to ASTM D 3238 method; 4%, % $C_N$ of ring analysis according to ASTM D 3238 method; 27%, and % $C_P$ of ring analysis according to ASTM D 3238 method; 69%)

Base oil 4: Naphthenic base oil (Properties and the like; Kinematic viscosity at 40° C.; 139.1 $mm^2/s$, Kinematic viscosity at 100° C.; 10.8 $mm^2/s$, Viscosity index; 35, Density at 15° C.; 0.918 $g/cm^3$, % $C_A$ of ring analysis according to ASTM D 3238 method; 11%, % $C_N$ of ring analysis according to ASTM D 3238 method; 39%, and % $C_P$ of ring analysis according to ASTM D 3238 method; 50%)

Additive 1: 2, 6-di-tert-butylphenol

Additive 2: tris (2, 4-di-tert-butylphenyl) phosphite

Additive 3: Calcium salicylate

Additive 4: 4, 4'-methylenebis-(2,6-di-tert-butylphenol)

Additive 5: BHT (butylhydroxytoluene) (2,6-di-tert-butyl-4-methylphenol)

Additive 6: Benzenepropanoic acid 3,5-bis (1,1-dimethyl-ethyl) -4-hydroxy-C7 to C9 side chain alkyl ester Additive 7: Additive package for compressor oil containing ZnDTP, rust preventive agent, demulsifier and antifoaming agent The following Experiment Example and Control Experiment Examples were then prepared.

Experiment Example 1

1.000 mass % of additive 1, 0.500 mass % of additive 2 and 0.075 mass % of additive 3 were added to a mixed base oil obtained by mixing 24.000 mass % of the base oil 1, 17.000 mass % of the base oil 2, 8.410 mass % of the base oil 3 and 48.330 mass % of the base oil 4. Further, 0.685 mass % of additive 7 was added to the above mixture and mixed well to obtain a compressor oil of Inventive Example 1.

Control Experiment Examples 1 to 3

Compressor oils of Control Examples 1 to 3 were obtained in accordance with the above Experiment Example 1 except for using the compositions shown in Table 1.

Test on Preliminary Experiment Example

The following test was conducted to know the performance of the above Experiment Example and the Control Experiment Examples.

Oxidation Stability Test (Dry-TOST):

The test was conducted at 120° C. for 168 hours according to the oxidation stability test (Dry-TOST method) of ASTM D7873.

After the test, the test was conducted at a test temperature of 150° C. under a pressure of 620 kPa before heating in accordance with JIS K 2514-3 Rotating Bomb Oxidation Stability Test (RPVOT), and the time from maximum pressure to 175 kPa drop was measured (RPVOT value: min). It can be said that the lubricating oil composition is excellent in oxidation stability as the time is longer.

Further, from the RPVOT value (min) after the Dry-TOST test, the RPVOT value residual ratio (%) was calculated by the following formula.

[RPVOT value residual ratio]=[RPVOT value after test/initial RPVOT value]×100

The criteria for evaluation of oxidation stability are as follows.

| | |
|---|---|
| RPVOT value residual ratio is 85% or more | Good (○) |
| RPVOT value residual ratio is less than 85% | Not good (X) |

The test results for the preliminary experiments are shown in Table 1.

TABLE 1

| | Inventive Example 1 | Control Example 1 | Control Example 2 | Control Example 3 |
|---|---|---|---|---|
| Base oil 1 | 24.000 | 24.000 | 24.000 | 24.000 |
| Base oil 2 | 17.000 | 17.000 | 17.000 | 17.000 |
| Base oil 3 | 8.410 | 8.410 | 8.410 | 8.410 |
| Base oil 4 | 48.330 | 48.330 | 48.330 | 48.330 |
| Additive 1 | 1.000 | — | — | — |
| Additive 2 | 0.500 | 0.500 | 0.500 | 0.500 |
| Additive 3 | 0.075 | 0.075 | 0.075 | 0.075 |
| Additive 4 | — | 1.000 | — | — |
| Additive 5 | — | — | 1.000 | — |
| Additive 6 | — | — | — | 1.000 |
| Additive 7 | 0.685 | 0.685 | 0.685 | 0.685 |
| Total | 100 | 100 | 100 | 100 |
| % Cp | 71 | 71 | 71 | 71 |
| % Cn | 23 | 23 | 23 | 23 |
| % Ca | 6 | 6 | 6 | 6 |
| RPVOT of new oil (min) | 116 | 92 | 106 | 86 |
| RPVOT after Dry TOST (min) | 120 | 56 | 44 | 28 |
| RPVOT residual ratio | 103 ○ | 61 X | 42 X | 33 X |

As shown in Table 1, when 1 mass % of 2, 6-di-tert-butylphenol (Additive 1) of Experiment Example 1 was used, it was found that the RPVOT value after the Dry-TOST test does not decrease from the RPVOT value of the fresh oil, the RPVOT value residual ratio is good, and the oxidation stability is excellent.

On the other hand, in Control Experiment Example 1, when the same amount of 4, 4'-methylenebis (2, 6-di-tert-butylphenol) (Additive 4) was used instead of additive 1 in Experiment Example 1, the RPVOT value residual ratio was low, and good results were not obtained.

In Control Experiment Example 2, when the same amount of BHT (Additive 5) was used instead of additive 1 in Experiment Example 1, the residual ratio of RPVOT value was further lower, and good results were not obtained.

In Control Experiment Example 3, when the same amount of benzene propanoic acid 3, 5-bis (1, 1-dimethyl-ethyl)-4-hydroxy-C7 to C9 side chain alkyl ester (additive 6) was used instead of additive 1 in Experiment Example 1, the RPVOT value residual ratio was further lower and good results were not obtained.

In Control Experiment Example 2, adhesion to the condenser was observed by sublimation of BHT (Additive 5) after the Dry-TOST test.

On the other hand, in Experiment Example 1, such adhesion was not observed and it was confirmed that there was no problem concerning the sublimability of 2, 6-di-tert-butylphenol (Additive 1).

Thus, 2, 6-di-tert-butylphenol was found to be a preferred antioxidant in compressor oil without having problems in sublimability and oxidation stability.

This is because the 2, 6-di-tert-butylphenol exists in a state of forming a dimer called 3, 3', 5, 5'-tetra-tert-butyl-4, 4'-diphenoquinone of the following formula due to the fact that the 4-position of the benzene ring is a hydrogen atom as described above; hence it is difficult to sublimate. Thus, the expression of the antioxidant function of 3, 3', 5, 5'-tetra-tert-butyl-4, 4'-diphenoquinone could be found by the combination effect (synergistic effect) of the additives.

Chemical formula 5:

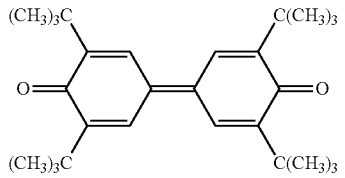

Inventive and Comparative Examples

Based on the above preliminary experiment, the following materials were prepared in order to prepare Examples and Comparative Examples. In addition, the compressor oil of the present invention will be specifically described below with reference to Examples and Comparative Examples, but the present invention is not at all limited thereto.

Base oil 1: Same as the base oil 1 of the preliminary experiment.

Base oil 2: Same as the base oil 2 of the preliminary experiment.

Base oil 4: Same as the base oil 4 of the preliminary experiment.

Base oil 5: Fischer-Tropsch base oil by gas-to-liquid method (Properties and the like: Kinematic viscosity at 40° C.; 44.9 $mm^2/s$, Kinematic viscosity at 100° C.; 7.7 $mm^2/s$, Viscosity index; 142, Density at 15° C.; 0.828 $g/cm^3$, % $C_A$ of ring analysis according to ASTM D 3238 method; 0%, % $C_N$ of ring analysis according to ASTM D 3238 method; 8%, and % $C_P$ of ring analysis according to ASTM D 3238 method; 92%)

Additive 1: Same as additive 1 of the preliminary experiment. (2, 6-di-tert-butylphenol)

Additive 2: Same as additive 2 of the preliminary experiment. (tris(2, 4-di-tert-butylphenyl) phosphite)

Additive 3: Same as additive 3 of the preliminary experiment. (Ca Salicylate)

Additive 4: Same as additive 4 of the preliminary experiment. (4,4'-methylenebis (2,6-di-tert-butylphenol))

Additive 7: Same as additive 7 of the preliminary experiment. (Additive package for compressor oil containing ZnDTP, rust preventive agent, demulsifier and anti-foaming agent)

The following Inventive Examples and Comparative Examples were prepared.

Inventive Example 1

1.000 mass % of additive 1 and 0.500 mass % of additive 2 were added to a mixed base oil obtained by mixing 32.485 mass % of the base oil 1, 17.000 mass % of the base oil 5 and 48.330 mass % of the base oil 4. Further, 0.685 mass % of the additive 7 was added to the above mixture and mixed well to obtain a compressor oil of Inventive Example 1.

Inventive Examples 2 to 6

Compressor oils of Inventive Examples 2 to 6 were obtained in accordance with Inventive Example 1 except for using the compositions shown in Table 2 and Table 3.

Comparative Examples 1 to 10

Compressor oils of Comparative Examples 1 to 10 were obtained in accordance with Inventive Example 1 except for using the compositions shown in Table 4 and Table 5.

Test

The following test was conducted to know the performance of the Inventive Examples and the Comparative Examples.

An ISOT test (oxidation stability test) was conducted, wherein the test equipment and the test method were in accordance with JIS K 2514, the catalyst was immersed in the sample, and the sample was stirred with a stirring rod for 72 hours at 150° C. and oxidized. The acid value after ISOT test was determined by potentiometric titration. The evaluation criteria are as follows.

| | |
|---|---|
| 0.6 mg KOH/g or less | Good (○) |
| More than 0.6 mg KOH/g | Not good (X) |

For the compressor oil after the above ISOT test, the sludge produced in the compressor oil to be tested was filtered in accordance with the quantitative method and the apparatus (filter pore size: 0.8 μm) described in JIS B 9931 (Method for measuring hydraulic oil contamination by mass method). The filtered sludge was then washed with n-hexane and the amount of sludge was determined. The evaluation criteria are as follows.

| | |
|---|---|
| 0 mg/100 ml to less than 10 mg/100 ml | Excellent (◎) |
| 10 mg/100 ml or more to 70 mg/100 ml or less | Good (○) |
| More than 70 mg/100 ml | Not good (X) |

Pour point was measured in accordance with JIS K 2269.

A Panel coking test test was conducted in accordance with the U.S. Federal District Engineering Mutual Statement 791-3462, wherein the test oil with an oil temperature set at 90° C. was splashed with a rotating splasher over 12 hours at intervals of rotation time of 1 second/stop time of 14 seconds on an aluminum panel heated and set to a specified temperature of 270° C. This test was conducted to evaluate the suppression performance of the test oil to suppress deposit formation, namely, cleanliness, from weight increase of panel before and after test.

The test results are indicated by the weight increase (mg) of the aluminum panel, and the indices of the evaluation showing the high temperature cleanliness are as follows.

| | |
|---|---|
| 0 mg to 20.0 mg | Excellent (◎) |
| More than 20.0 mg to 100.0 mg or less | Good (○) |
| More than 100.0 mg | Not good (X) |

The results of the tests are shown in Tables 2 to 5. Note that, in each of the tables, for the test results which are not described, the tests were omitted from the results of other tests.

As shown in Table 2, when 1 mass % of 2, 6-di-tert-butylphenol (additive 1) and 0.5 mass % of tris (2, 4-di-tert-butylphenyl) phosphite (additive 2) were used in Inventive Example 1, good results were obtained, i.e. a reciprocating compressor oil having small increase in the acid value and good sludge amount (○) after the oxidation stability test (ISOT), having low pour point, i.e. −35° C. and good panel coking test result (○) and can withstand high temperature and high pressure, was obtained.

In Inventive Example 2, the use amount of additive 1 and additive 2 was increased to about twice that in Inventive Example 1. As a result, good results (○) were obtained for both the acid value and the sludge amount after ISOT. Thus, favorable results were obtained.

In Inventive Example 3, the amount of the additive 1 used was changed to 5.0 mass % which is 5 times higher than that of Inventive Example 1, and the amount of the base oil 1 was reduced accordingly. As a result, even more favorable results were obtained as compared with Inventive Example 1.

In Inventive Example 4 shown in Table 3, 0.075 mass % of Ca salicylate (additive 3) was added to Inventive Example 1. As a result, the sludge amount after ISOT showed excellent results (◎), and the performance was further improved.

In Inventive Example 5, the amount of Ca salicylate in Inventive Example 4 was increased to 0.5 mass %, and even better results were obtained for the panel coking test.

In Inventive Example 6, the amount of the Ca salicylate in Inventive Example 4 was further increased to 1.0 mass %. As a result, the compressor oil giving better results as a whole was obtained.

On the other hand, in the Comparative Examples shown in Table 4, the additive 1 in Inventive Example 1 was used and the additive 2 was not used. The acid value after ISOT was good but the amount of sludge was very large; thus, good results were not obtained. In Comparative Example 2, the amount of additive 1 used was increased to 3.0 mass % with respect to Comparative Example 1, but both the acid value and the sludge amount after ISOT were poor, which is not preferable as a reciprocating compressor oil.

In Comparative Example 3, the additive 2 in Inventive Example 1 was used, and the additive 1 was not used. The acid value after ISOT was also poor and the amount of sludge was also very large, which are not favorable results. In Comparative Example 4, the amount of the additive 2 used in Comparative Example 3 was increased to 3.0 mass %. The acid value after ISOT was improved, but the amount of sludge was not yet satisfactory, which is not preferable.

In Comparative Example 5, 1.0 mass % of additive 4, a phenolic antioxidant was used instead of additive 1. As a result, the panel coking test showed good (○) result, but the result of acid value and sludge amount after ISOT was poor (x), which is not preferable.

In Comparative Example 6, 1.0 mass % of additive 2 and 0.075 mass % of additive 3 were added to the composition of Comparative Example 5. As a result, the amount of sludge decreased and showed good result ((○)), but the acid value was poor (x); thus, good results were not obtained.

In Comparative Example 7, the amount of base oil 4 and base oil 1 of Example 4 was high as 90.0 mass %, and 7.74 mass %, respectively, (both based on the total amount). The naphthene content was high, and excellent results (0) were obtained in the panel coking test. However, the acid value after ISOT was poor and the numerical value of sludge amount was extremely poor. Thus, it is not preferable as compressor oil.

In Comparative Example 8, the amount of the base oil 4 and base oil 1 of Comparative Example 7 was 75.0 mass % and 22.74 mass %. The naphthene content was high, and excellent results (◎) were obtained in the panel coking test. However, the acid value after ISOT was still poor and the numerical value of sludge amount was also extremely poor. Thus, preferable compressor oil was not obtained.

In Comparative Example 9, the amount of base oil 4 of Comparative Example 8 was reduced to 25.0 mass % and the amount of base oil 5 was increased to 50.0 mass %. The naphthene content was low, and extremely poor results were obtained in the panel coking test. Thus, it is not preferable as compressor oil.

In Comparative Example 10, the base oil 2 was used in place of base oil 1 and base oil 5 of Example 4, and its use amount was increased to 54.41 mass %. The naphthene content was high, the acid value and the numerical value of sludge amount after ISOT and the panel coking test were excellent, but the pour point increased causing problem in use at low temperature.

Note that the compressor oil of Experiment Example 1 prepared in the above preliminary test can be used in the same manner as in the above-mentioned Examples.

TABLE 2

| | Example 1 | Example 2 | Example 3 |
|---|---|---|---|
| Base oil 1 | 32.485 | 32.338 | 28.485 |
| Base oil 5 | 17.000 | 16.667 | 17.000 |
| Base oil 2 | — | — | — |
| Base oil 4 | 48.330 | 47.382 | 48.330 |
| Additive 1 | 1.000 | 1.961 | 5.000 |
| Additive 2 | 0.500 | 0.980 | 0.500 |
| Additive 3 | — | — | — |
| Additive 4 | — | — | — |
| Additive 7 | 0.685 | 0.672 | 0.685 |
| Total | 100 | 100 | 100 |
| % Cp | 71 | 71 | 70 |
| % Cn | 23 | 23 | 24 |
| % Ca | 6 | 6 | 6 |
| Pour point (° C.) | −35.0 | −35.0 | −35.0 |
| Acid value of fresh oil | 0.29 | 0.28 | 0.36 |
| Acid value after ISOT | 0.52 | 0.35 | 0.48 |
| Sludge amount after ISOT | ○ | ○ | ○ |
| Panel coking test | 54.8 ○ | | 34.7 ○ |

TABLE 3

| | Example 4 | Example 5 | Example 6 |
|---|---|---|---|
| Base oil 1 | 32.410 | 31.985 | 31.485 |
| Base oil 5 | 17.000 | 17.000 | 17.000 |
| Base oil 2 | — | — | — |
| Base oil 4 | 48.330 | 48.330 | 48.330 |
| Additive 1 | 1.000 | 1.000 | 1.000 |
| Additive 2 | 0.500 | 0.500 | 0.500 |
| Additive 3 | 0.075 | 0.500 | 1.000 |
| Additive 4 | — | — | — |
| Additive 7 | 0.685 | 0.685 | 0.685 |
| Total | 100 | 100 | 100 |
| % Cp | 71 | 71 | 71 |
| % Cn | 23 | 23 | 23 |
| % Ca | 6 | 6 | 6 |
| Pour point (° C.) | −35.0 | −35.0 | −35.0 |
| Acid value of fresh oil | 0.32 | 0.47 | 0.54 |
| Acid value after ISOT | 0.53 | 0.38 | 0.44 |
| Sludge amount after ISOT | ○ 9.6 ◎ | ○ 2.8 ◎ | ○ 2.0 ◎ |
| Panel coking test | 59.5 ○ | 16.4 ◎ | 1.9 ◎ |

TABLE 4

| | Comp. Example 1 | Comp. Example 2 | Comp. Example 3 | Comp. Example 4 |
|---|---|---|---|---|
| Base oil 1 | 32.985 | 30.985 | 32.985 | 31.985 |
| Base oil 5 | 17.000 | 17.000 | 17.000 | 16.000 |
| Base oil 2 | — | — | — | — |
| Base oil 4 | 48.330 | 48.330 | 48.330 | 48.330 |
| Additive 1 | 1.000 | 3.000 | — | — |
| Additive 2 | — | — | 0.500 | 3.000 |
| Additive 3 | — | — | — | — |
| Additive 4 | — | — | — | — |
| Additive 7 | 0.685 | 0.685 | 0.685 | 0.685 |
| Total | 100 | 100 | 100 | 100 |
| % Cp | 71 | 71 | 71 | 71 |
| % Cn | 23 | 23 | 23 | 23 |
| % Ca | 6 | 6 | 6 | 6 |
| Pour point (° C.) | −35.0 | −35.0 | −35.0 | −35.0 |
| Acid value of fresh oil | 0.32 | 0.33 | 0.36 | 0.38 |
| Acid value after ISOT | 0.48 ○ | 0.65 X | 0.78 X | 0.40 X |
| Sludge amount after ISOT | 209.6 X | 242 X | 611.2 X | 174.8 X |
| Panel coking test | — | — | — | — |

TABLE 5

| | Comp. Ex. 5 | Comp. Ex 6 | Comp. Ex 7 | Comp. Ex 8 | Comp. Ex 9 | Comp. Ex 10 |
|---|---|---|---|---|---|---|
| Base oil 1 | 32.985 | 32.985 | 7.74 | 22.74 | 22.74 | — |
| Base oil 5 | 17.000 | 17.000 | — | — | 50.000 | — |
| Base oil 2 | — | — | — | — | — | 54.410 |
| Base oil 4 | 48.330 | 48.330 | 90.000 | 75.000 | 25.000 | 43.330 |
| Additive 1 | — | — | 1.000 | 1.000 | 1.000 | 1.000 |
| Additive 2 | — | 1.000 | 0.500 | 0.500 | 0.500 | 0.500 |
| Additive 3 | — | 0.075 | 0.075 | 0.075 | 0.075 | 0.075 |
| Additive 4 | 1.000 | 1.000 | — | — | — | — |
| Additive 7 | 0.685 | 0.685 | 0.685 | 0.685 | 0.685 | 0.685 |
| Total | 100 | 100 | 100 | 100 | 100 | 100 |
| % Cp | 71 | 71 | 53 | 60 | 81 | 60 |
| % Cn | 23 | 23 | 36 | 31 | 16 | 33 |
| % Ca | 6 | 6 | 11 | 9 | 3 | 7 |
| Pour point (° C.) | −35.0 | −35.0 | — | — | — | −22.5 |
| Acid value of fresh oil | 0.31 | 0.30 | 0.35 | 0.35 | — | 0.41 |
| Acid value after ISOT | 1.09 X | 1.22 X | 2.35 X | 1.60 X | — | 0.34 ○ |
| Sludge amount after ISOT | 297.0 X | ○ | 1593.6 X | 916.0 X | — | 4.2 ◎ |
| Panel coking test | 51.2 ○ | — | 9.0 ◎ | 7.1 ◎ | 236.8 X | 2.4 ◎ |

That which is claimed:

1. A reciprocating compressor oil comprising:

a base oil selected from one or more of a mineral oil and a synthetic oil, wherein the base oil has a naphthene component in an amount ranging from 17% to 30% in the % $C_N$ of ring analysis according to ASTM D3238;

a 2, 6-di-tert-butylphenol is present in an amount ranging from 0.5 mass % and 6.0 mass %, based on the total amount of the reciprocating compressor oil; and a tris (2, 4-di-tert-butylphenyl) phosphite is present in an amount ranging from 0.3 mass % to 2.0 mass %, based on the total amount of the reciprocating compressor oil, wherein the reciprocating compressor oil has a pour point of less than −25° C.

2. The reciprocating compressor oil according to claim 1, wherein the compressor oil further comprises an alkaline earth metal salt of salicylate in an amount ranging from 0.05 mass % to 2.0 mass %, based on the total amount of the reciprocating compressor oil.

3. The reciprocating compressor oil according to claim 2, wherein the alkaline earth metal salt of the salicylate is Ca salicylate.

4. The reciprocating compressor oil according to claim 2, wherein the alkaline earth metal salt is present in an amount ranging from 0.075 mass % to 1.5 mass %, based on the total amount of the reciprocating compressor oil.

5. The reciprocating compressor oil according to claim 4, wherein the alkaline earth metal salt is Ca salicylate.

6. The reciprocating compressor oil according to claim 2, wherein the alkaline earth metal salt is present in an amount ranging from 0.075 mass % to 1.0 mass % based on the total amount of the reciprocating compressor oil.

7. The reciprocating compressor oil according to claim 6, wherein the alkaline earth metal salt is Ca salicylate.

8. The reciprocating compressor oil according to claim 1, wherein the 2, 6-di-tert-butylphenol is present in an amount ranging from 1.0 mass % to 5.0 mass %, based on the total amount of the reciprocating compressor oil.

9. The reciprocating compressor oil according to claim 1, wherein the tris (2, 4-di-tert-butylphenyl) phosphite is present in an amount ranging from 0.5 mass % to 1.0 mass %, based on the total amount of the reciprocating compressor oil.

10. The reciprocating compressor oil according to claim 1, wherein the reciprocating compressor oil further comprises one or more known additives.

11. The reciprocating compressor oil according to claim 1, wherein the reciprocating compressor oil further comprises an additive package not containing any one of an antioxidant and a detergent dispersant.

12. The reciprocating compressor oil according to claim 1, wherein the pour point of the reciprocating compressor oil is at most −30° C.

13. The reciprocating compressor oil according to claim 1, wherein the pour point of the reciprocating compressor oil is at most −35° C.

* * * * *